United States Patent [19]

Mrugala

[11] 4,019,283

[45] Apr. 26, 1977

[54] GRINDING MACHINE LOADER ASSEMBLY

[75] Inventor: Theodore A. Mrugala, Auburn, Mass.

[73] Assignee: The Warner & Swasey Company, Cleveland, Ohio

[22] Filed: Dec. 17, 1975

[21] Appl. No.: 641,540

[52] U.S. Cl. ..... 51/103 C; 51/215 AR; 51/215 CP

[51] Int. Cl.[2] ..... B24B 5/04; B24B 41/00

[58] Field of Search ..... 51/103 C, 103 WH, 105 R, 51/108 R, 215 R, 215 AR, 215 HM, 89, 118, 215 CP, 215 H, 237 T

[56] References Cited

UNITED STATES PATENTS

| | | | |
|---|---|---|---|
| 1,820,735 | 8/1931 | Fraser | 51/215 AR X |
| 2,156,453 | 5/1939 | Hamilton | 51/215 HM X |
| 2,517,193 | 8/1950 | Fraser | 51/215 AR X |
| 2,805,524 | 9/1957 | Silven | 51/215 HM X |
| 3,073,074 | 1/1963 | Price | 51/215 AR X |
| 3,425,169 | 2/1969 | Dunn | 51/215 HM X |
| 3,553,907 | 1/1971 | Price | 51/215 R |

*Primary Examiner*—Al Lawrence Smith
*Assistant Examiner*—Nicholas P. Godici

[57] ABSTRACT

An improved grinding machine loader assembly includes a rotatable wheel upon which a plurality of workpiece supports are mounted at equally spaced apart locations. After a latch member has been moved into engagement with the wheel and a locking member has been disengaged from the wheel, an index motor is operated through a loading stroke to pivot an index arm on which the latch member is disposed. This pivotal movement of the index arm and latch member rotates the wheel through an arcuate distance equal to the distance between the workpiece supports. As the wheel rotates, a workpiece on one of the supports is moved into a work area where it is engaged by the headstock and footstock of the grinding machine. The locking member is then moved back into engagement with the wheel and the latch member is disengaged from the wheel. After the latch member has been disengaged, the index motor is operated through a return stroke without moving the wheel. If during a loading cycle an empty workpiece support is moved into the work area, the loading cycle is automatically repeated to move the next succeeding workpiece support into the work area. The finished workpieces are discharged through a chute and a detector is provided to interrupt operation of the loading assembly if the chute should become full of finished workpieces.

23 Claims, 6 Drawing Figures

GRINDING MACHINE LOADER ASSEMBLY

BACKGROUND OF THE INVENTION

This invention relates generally to a grinding machine and more specfically to an improved loading apparatus which is utilized to sequentially transport a plurality of workpieces to a work area in a grinding machine.

There are many known devices for transporting workpieces to a work area. Some of these known devices include loading wheels which are driven by mechanisms which may be either relatively complicated or difficult to fabricate. Thus, the loading device disclosed in U.S. Pat. No. 2,137,644 utilizes a Geneva drive arrangement to rotate a loading wheel. A swastika wheel is utilized in association with a discharge chute.

A different type of loading wheel drive is disclosed in U.S. Pat. No. 2,433,717. The loading wheel disclosed in this patent is indexed by a stripping mechanism of the ratchet and pawl type. The loading wheel is loaded on its underside and the finished workpieces are discharged at the top of the wheel. As the workpieces enter the wheel, they are held against loading blocks by a belt which encircles most of the wheel. This belt also functions to rotate the workpieces in the loading blocks during a grinding operation.

Another apparatus utilizing a Geneva mechanism to index a loading wheel is disclosed in U.S. Pat. No. 2,805,524. During operation of the loading apparatus disclosed in this patent, the loading wheel is indexed to present workpieces to the grinding zone where they are picked up magnetic chucks. The loading wheel then moves away from the grinding or work zone while the workpiece is ground. After the workpiece has been finished, the loading wheel moves back into the grinding zone and picks up the finished workpiece and the wheel is indexed to place another workpiece in the grinding zone.

A wheel for loading workpieces into a grinding machine is also disclosed in U.S. Pat. No. 3,073,074. This loading wheel includes a pair of disks which are mounted on a shaft. Each of the disks has work engaging notches in its periphery to support workpieces and move them from an input location to a grinding location and then from the grinding location to an exit chute. To effect rotation of the grinding wheel, an index ring attached to the grinding wheel is rotated by an oscillating disk having a plunger which engages the index ring. Mounted between the two disks of the loading wheel is a sizing control sensor which is moved into and out of engagement with the workpiece.

Still another indexable loading wheel is disclosed in U.S. Pat. No. 3,309,821. This loading wheel is utilized to transport workpieces from an infeed chute to a grinding zone and then to transfer finished workpieces to an output chute. Equally spaced work supports in the periphery of the loading wheel are adjustable so as to carry different sizes of workpieces. The output shaft of a hydraulic motor is rotated to index the wheel. This output shaft rotation is transferred to the loading wheel through a gear train.

SUMMARY OF THE PRESENT INVENTION

The present invention relates to a grinding machine having an improved workpiece loader assembly which sequentially transports a plurality of workpieces to a work area. The loader assembly includes an index motor which is operated through a loading stroke to effect pivotal movement of an index arm and rotation of a loading wheel to move an unfinished workpiece to the work area and to remove a finished workpiece from the work area. During the loading stroke, a latch assembly on the index arm engages the wheel. This latch assembly is moved with the wheel by the index motor to effect movement of the loading wheel. During a return stroke of the index motor, the wheel is held stationary by a lock assembly. The latch assembly is retracted during the return stroke so that the index motor is ineffective to cause rotation of the loading wheel.

It is contemplated that during operation of the loading apparatus, the loading wheel may be rotated to move an empty workpiece support into the work area. When this occurs, the loading cycle is automatically repeated to move the next succeeding workpiece support into the work area. It is also contemplated that during operation of the machine a finished workpiece discharge chute may become filled. A suitable detector is provided to prevent the initiation of a loading cycle when the discharge chute is filled. In addition, it is contemplated that the grinding machine will be utilized to perform work operations in which the loading apparatus will not be utilized. During the performance of these work operations, the loading apparatus is moved to an inactive position in which the wheel is spaced apart from the work area.

Accordingly, it is an object of this invention to provide an apparatus for use in sequentially grinding a plurality of workpieces in a work area and wherein the apparatus includes a new and improved loading assembly which is relatively simple in construction, reliable in operation, and is operable to sequentially transport workpieces to the work area.

Another object of this invention is to provide an apparatus as set forth in the foregoing paragraph and wherein the loading assembly includes a plurality of workpiece supports disposed on a rotatable wheel, an indexable motor which is effective to move a latch member through a loading stroke to rotate the wheel, a locking motor for moving a locking member into engagement with the wheel at the end of a loading stroke to hold the wheel against further rotation, and a latch motor for moving the latch member out of engagement with the wheel after the wheel has been engaged by the locking member to enable the index motor to move through a turn stroke without effecting movement of the wheel.

Another object of this invention is to provide an apparatus for use in sequentially grinding a plurality of workpieces in a work area and wherein the apparatus includes a loading wheel and an index motor which is operable to move an index arm on which a latch member is disposed to thereby rotate the loading wheel.

Another object of this invention is to provide an apparatus for use in sequentially grinding a plurality of workpieces in a work area and wherein a loading wheel is supported for movement between an operating position in which the wheel extends into the work area and an inactive position in which the wheel is spaced apart from the work area.

BRIEF DESCRIPTION OF THE DRAWINGS

The foregoing and other objects and features of the present invention will become more apparent upon a consideration of the following description taken in conjunction with the accompanying drawings wherein.

DESCRIPTION OF ONE SPECIFIC PREFERRED EMBODIMENT OF THE INVENTION

GENERAL DESCRIPTION

Figure 1:
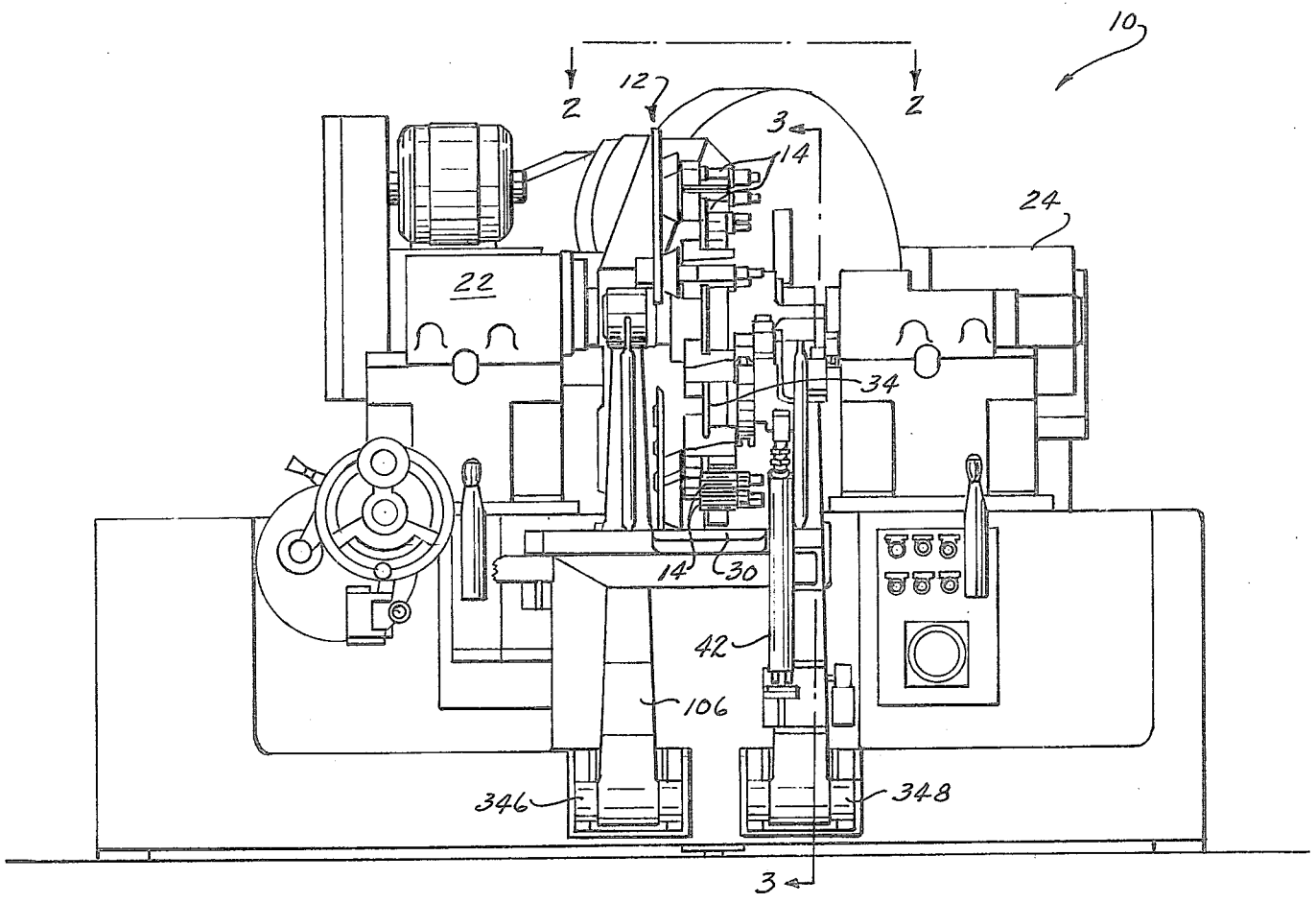
FIG. 1 is an elevational view of a grinding machine having a workpiece loading apparatus constructed in accordance with the present invention.

A grinding machine 10 is illustrated in FIG. 1 and has an improved workpiece loading and unloading apparatus 12 which is utilized to sequentially transport a plurality of workpieces 14 to a work area 16 (FIG. 2) where the workpieces are engaged by a spindle chuck 20 in a headstock 22 and by a footstock 24. The headstock 22 and footstock 24 shift the workpiece 14 axially from the loading position shown in dashed lines in FIG. 2 to the working position shown in solid lines in FIG. 2. The spindle chuck 20 of the headstock 22 then rotates the workpiece about its central axis 26. As the workpiece 14 is being rotated about the axis 26, it is finished by a rotating grinding wheel 28. When a workpiece 14 has been finished, the spindle chuck 20 releases the workpiece and is moved back to the loading position shown in dashed lines in FIG. 2 and is subsequentially deposited in a discharge chute 30 (FIGS. 1 and 3).

The loading apparatus 12 includes a circular wheel 34 which is rotatably supported on an axle 36. A plurality of workpiece support assemblies 38 are mounted at equally spaced apart locations about the periphery of the wheel 34. Although only a few of the workpiece support assemblies 38 have been illustrated in FIG. 3, it should be understood that in the illustrated embodiment of the invention there are nine workpiece support assemblies 38 which are mounted equal distances outwardly from the center of the axle 36 have central axes which extend parallel to the central axis of the axle 36. The central axis of each workpiece support assembly 38 is spaced apart from the axes of the adjacent workpiece support assemblies by an angle of forty degrees. Of course, a greater or lesser number of workpiece support assemblies could be utilized as long as the arcuate spacing between the workpiece support assemblies is equalized.

Upon operation of a piston and cylinder type index motor 42, the wheel 34 is rotated about the central axis of the axle 36 through an arcuate distance sufficient to move a finished workpiece 14 away from the work area 16 and to move an unfinished workpiece into the work area. In the illustrated embodiment of the invention in which nine workpiece support assemblies 38 are utilized, the wheel 34 is moved through an arcuate distance of forty degrees each time the index motor 42 is operated through a loading stroke. Of course, if a greater or lesser number of workpiece support assemblies 38 were utilized, the wheel 34 would be indexed through a lesser or greater arcuate distance.

Figure 3:
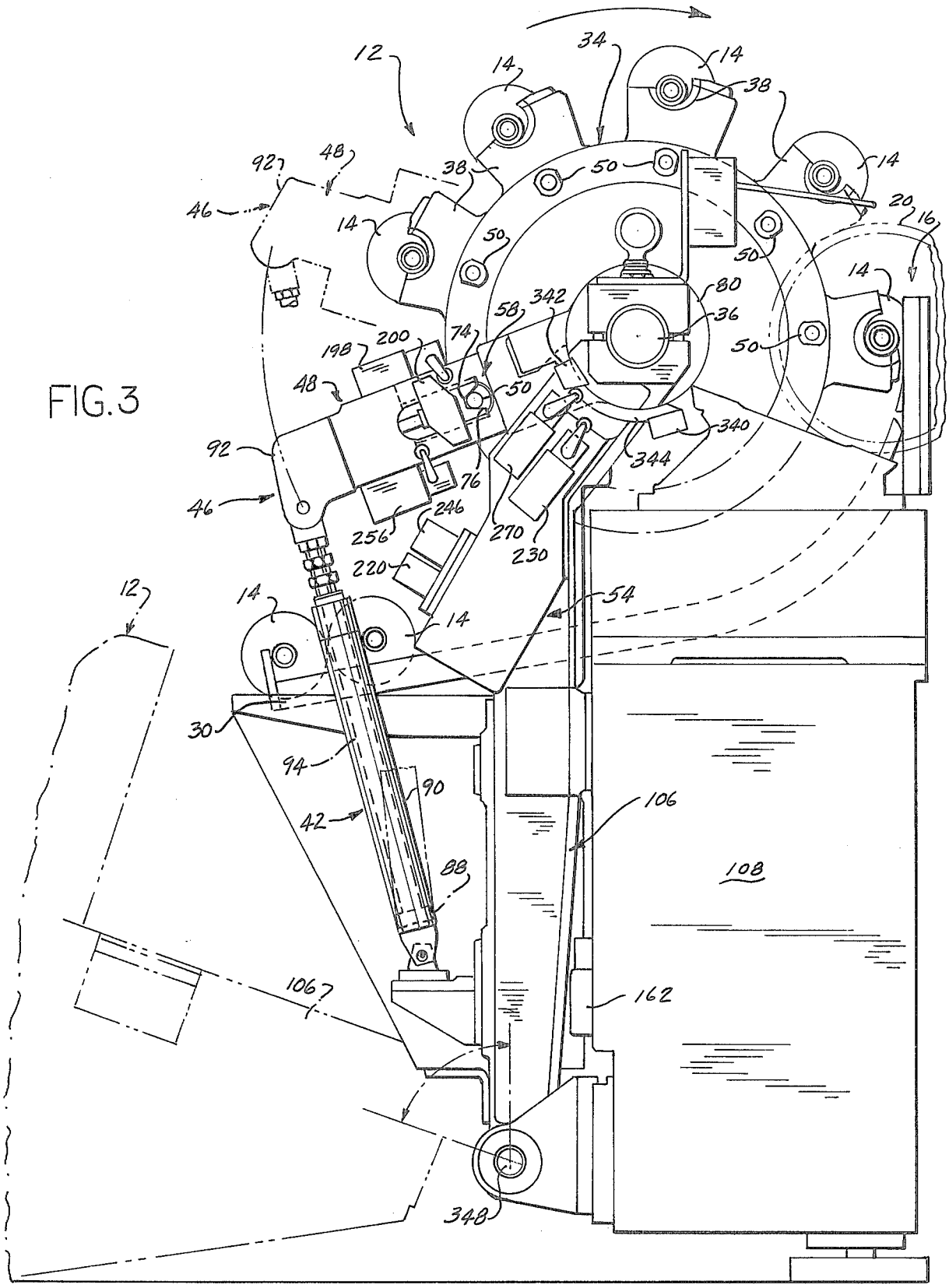
FIG. 3 is a side view, taken generally along the line 3—3 of FIG. 1, illustrating the relationship between the loading wheel, an index arm on which a latch assembly is disposed, an index motor for moving the index arm through a loading stroke to index the wheel, and a locking assembly for holding the wheel against rotation.

During a loading stroke of the index motor 42, an index or support arm 46 is pivoted about the axle 36 from the initial position illustrated in solid lines in FIG. 3 to the actuated position illustrated in dashed lines in FIG. 3. During this rotational movement of the index arm 46 about the central axis of the axle 36, a latch assembly 48 on the index arm 46 engages one of a plurality of index pins 50 on the wheel 34. The index pins 50 are disposed in a circular array having its center at the center of the axle 36. The index pins 50 are equally spaced apart with one index pin being associated with each of the workpiece support assemblies 38. Thus, in the illustrated embodiment of the invention in which there are nine workpiece support assemblies 38, there are nine index pins 50. Each of the index pins 50 has a central axis which extends parallel to the central axis of the axle 36 and is disposed in a flat plane containing the parallel central axes of the axle 36 and an associated one of the workpiece support assemblies 38.

Upon completion of a loading stroke by the index motor 42, a locking assembly 54 engages an index pin 50 and the latch assembly 48 is retracted out of engagement with another one of the index pins. The index motor 42 is then actuated through a return stroke to pivot the index arm 46 downwardly from the actuated position illustrated in dashed lines in FIG. 3 to the initial position illustrated in solid lines in FIG. 3. During this downward movement of the index arm 46 the locking assembly 54 holds the wheel 34 against rotation about the axle 36.

Figure 2:
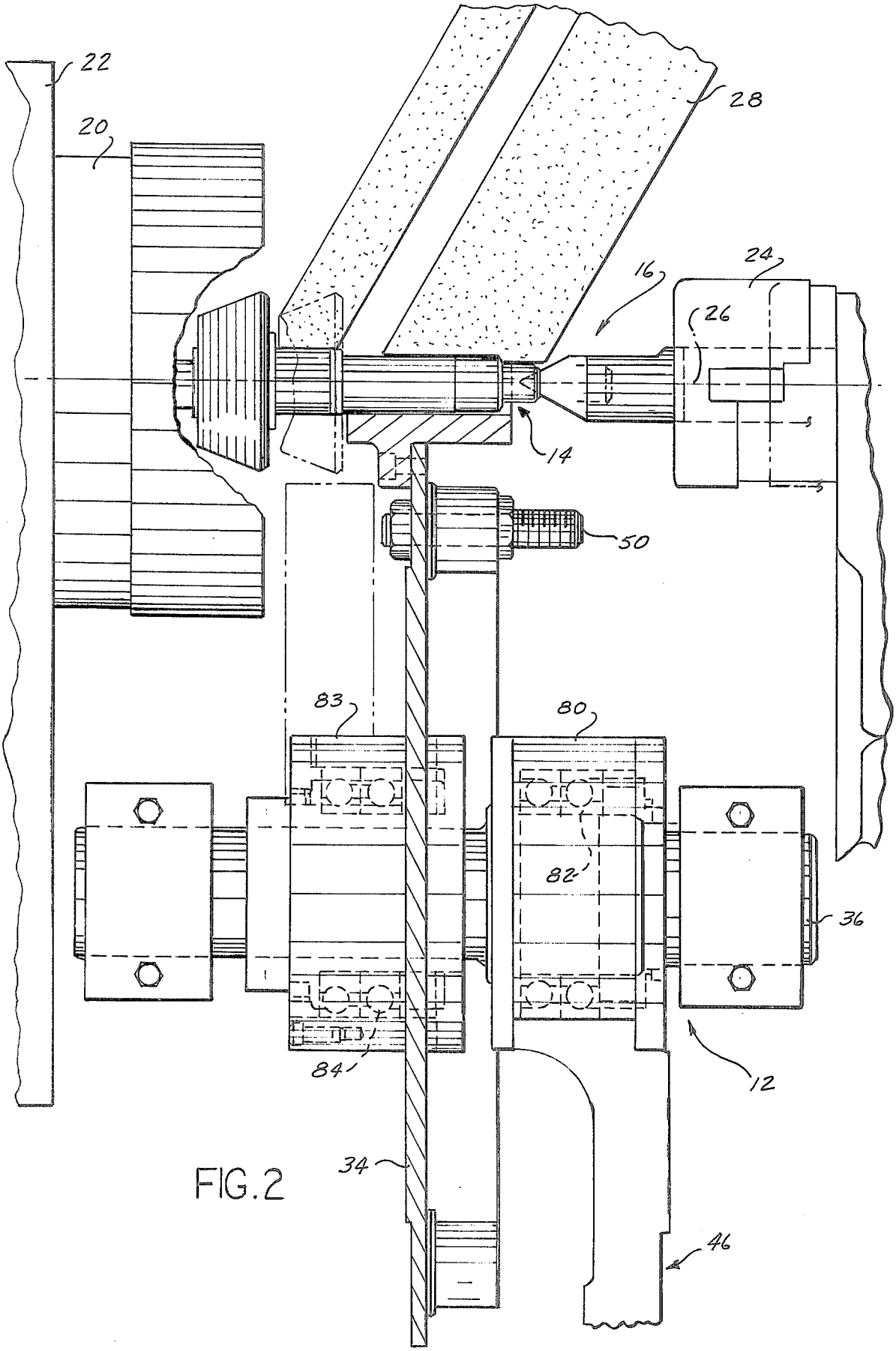
FIG. 2 is a plan view, taken generally along the line 2—2 of FIG. 1, illustrating the relationship between the loading wheel and the area where workpieces are finished by a grinding wheel.

When the grinding operation on a workpiece 14 in the work area 16 has been completed, the grinding wheel 28 is retracted from the work area and the headstock 22 is effective to move the finished workpiece axially back to the loading position on the associated workpiece support assembly 38, that is to the position shown in dashed lines in FIG. 2. The headstock 22 then effects actuation of a switch to cause the loading apparatus 12 to remove the finished workpiece 14 from the work area and move a next succeeding workpiece into the work area.

LATCH ASSEMBLY

Upon initiation of a loading cycle, the latch assembly 48 is operated from a retracted condition in which a latch member 58 is spaced apart from an indexing pin 50 (FIG. 4) to an extended position in which the latch member engages the indexing pin (FIG. 3). The latch member 58 is moved between the extended and retracted positions by a latch motor assembly 62 which is mounted on the arm 46. The latch motor assembly 62 includes a piston 66 (FIG. 4) which is disposed within a cylinder 68. The cylinder 68 is fixedly mounted on the index arm 46 along a radial plane extending outwardly from the center of the axle 36. The index member 58 is fixedly connected with a piston rod 72 extending outwardly from the piston 66. Upon initiation of a loading cycle, the piston 66 is moved axially outwardly from the retracted position of FIG. 4 to the extended position of FIG. 3. As the piston 66 moves outwardly, surfaces 74 and 76 on the latch member 58 move into engagement with opposite sides of the index pin 50.

Figure 4:
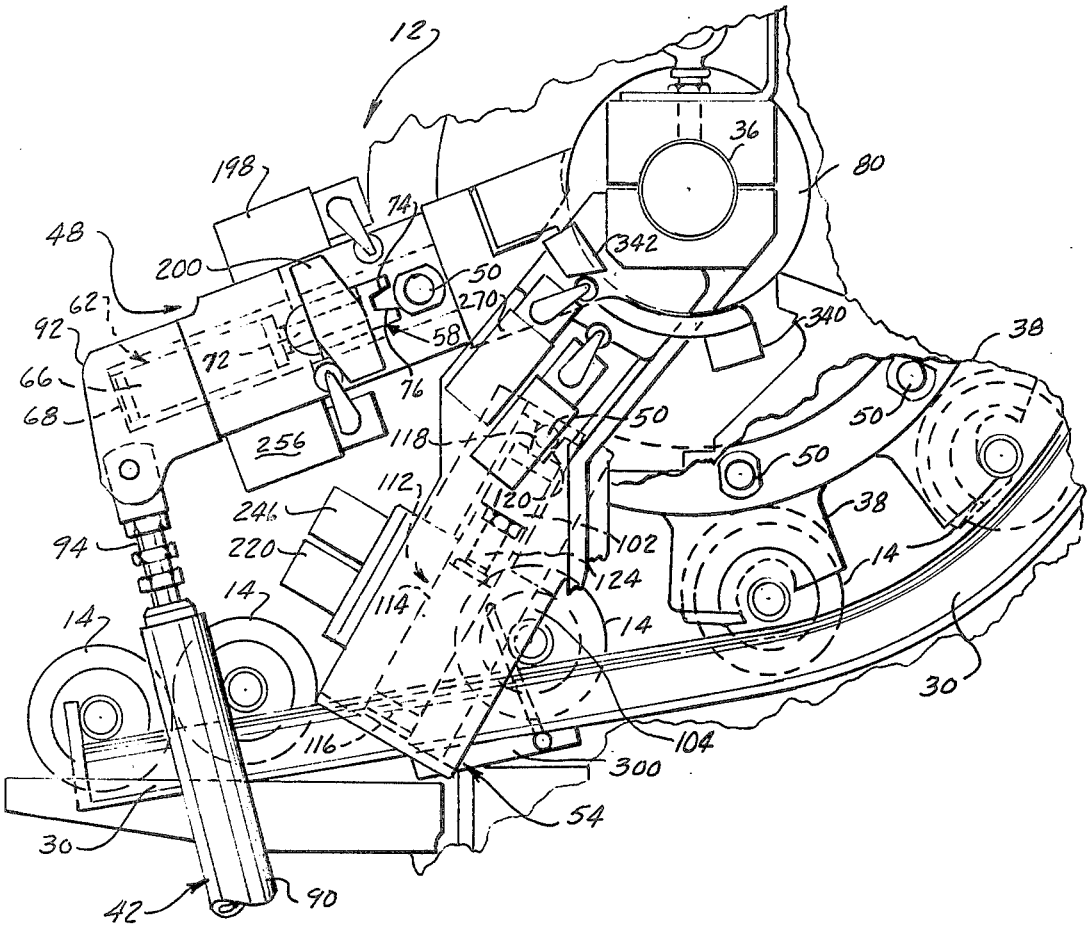
FIG. 4 is an enlarged fragmentary illustration depicting the relationship between the loading wheel, the latch assembly, and the locking assembly.

After the latch member 58 has engaged the index pin 50, the locking assembly 54 is operated from the engaged condition of FIG. 4 to a disengaged condition in which it is ineffective to hold the wheel 34 against rotation about the axle 36. The index motor 42 is then extended and the index arm 46 is pivoted in a clockwise direction (as viewed in FIG. 3) about the central axis of the axle 36. To provide for this pivoting movement, the index arm 46 has an inner end portion 80 (see FIG. 2) which is rotatably mounted on the non-rotatable axle 36 by a suitable bearing 82. As the index arm 46 is moved in the clockwise direction about the center of the axle shaft 36, the latch assembly 48, which is mounted on the index arm 46, effects rotational movement of the load wheel 34. The load wheel 34 has a hub portion 83 (FIG. 2) which is rotatably mounted on the fixed axle 36 by bearings 84. Thus, the wheel 34 is moved through an arcuate distance which is determined by the length of the loading stroke of the piston and cylinder type index motor 42. It should be noted that the index motor 42 has a piston 88 (FIG. 3) which is disposed within a cylinder 90 and is connected with outer end portion 92 of the index arm by a piston rod 94.

After the latch assembly 48 has been moved through a loading stroke from the initial position illustrated in solid lines in FIG. 3 to the actuated position illustrated in dashed lines, the locking assembly 54 is actuated to engage one of the index pins 50 and hold the wheel 34 against rotational movement. The latch assembly 48 is then operated to move the latch member 58 out of engagement with the index pin 50. Thus, after the locking assembly 54 has engaged the wheel 34, the latch motor 62 is actuated to move the piston 66 from the extended position illustrated in FIG. 3 to the retracted position illustrated in FIG. 4. As the piston 66 moves toward the retracted position, the latch member 58 moves out of engagement with the associated index pin 50.

Since the index arm 46 is freely rotatable about the axle 36, once the latch member 58 has moved out of engagement with the index pin 50, the index motor 42 cn be operated through a return stroke to move the index arm 46 from the actuated position illustrated in dashed lines in FIG. 3 back to the initial position illustrated in solid lines in FIG. 3. As this occurs, the latch member 54 is disposed radially outwardly of the index pins 50 and the wheel 34 is held against rotation by the engaged locking assembly 54. Once the index arm 46 and the latch assembly 48 have been moved through a return stroke to the initial position, the latch assembly 48 remains in the retracted condition until the next succeeding loading cycle is initiated.

LOCKING ASSEMBLY

The locking assembly 54 is utilized to hold the load wheel 34 against rotation during the return stroke of the index motor 42 and during grinding of a workpiece 14. The locking assembly 54 includes a locking member 102 (FIG. 4) which is movable into and out of engagement with an indexing pin 50. The locking member 102 is slidably mounted on a support plate 104 which is fixedly connected to a frame 106 (see FIG. 3) which is pivotally mounted on a base 108 of the grinding machine 10. During operation of the loading assembly 12, the frame is held against movement relative to the base 108 so that when the locking member 102 engages an index pin 50 in the manner illustrated in FIG. 4, the load wheel 34 is held against rotation relative to the base 108.

After the latch assembly 48 has engaged an index pin 50 in the manner illustrated in FIG. 3, a locking motor 112 (FIG. 4) is actuated to disengage the locking member 102 from the associated index pin 50. The locking motor 112 includes a piston 114 which is slidably received within a cylinder 116 having a central longitudinal axis disposed in a radial plane extending through the central axis of the axle 36. It should be noted that the latch assembly 48 and locking assembly 54 are spaced apart by an arcuate distance such that the locking member 102 can engage one index pin 50 while the latch member 58 can engage the next adjacent index pin when the index arm 46 and latch assembly are in the initial position illustrated in solid lines in FIG. 3.

When the locking member 102 is to be retracted, the piston 114 is moved axially outwardly away from the axle 36 (that is downwardly as viewed in FIG. 4) by a piston rod 124 which is fixedly connected with the locking member 102 and the piston 114. Upon completion of a loading stroke of the index motor 42, the piston 114 is moved toward the axle 36. Movement of the piston toward the axle 36 moves sloping side surfaces 118 and 120 on the locking member 102 into engagement with the adjacent index pin 50. This index pin 50 was moved into alignment with the locking member 102 during the loading stroke of the index motor 42.

After the locking member 102 has firmly engaged the index pin 50 to hold the wheel 34 against rotational movement about the axle 36, the latch assembly 48 is retracted in the manner previously explained and the index motor 42 operated through a return stroke. It should be noted that the locking assembly 54 is, during operation of the loading assembly 12, disposed in a fixed position relative to the base 108 and is thereby effective to hold the wheel 34 against rotation relative to the base. On the other hand, the latch assembly 48 is mounted on the index arm 46 for movement therewith so as to effect rotational movement of the wheel 34 relative to the base when the locking assembly 54 is in the disengaged condition.

CONTROL APPARATUS

Figure 5:
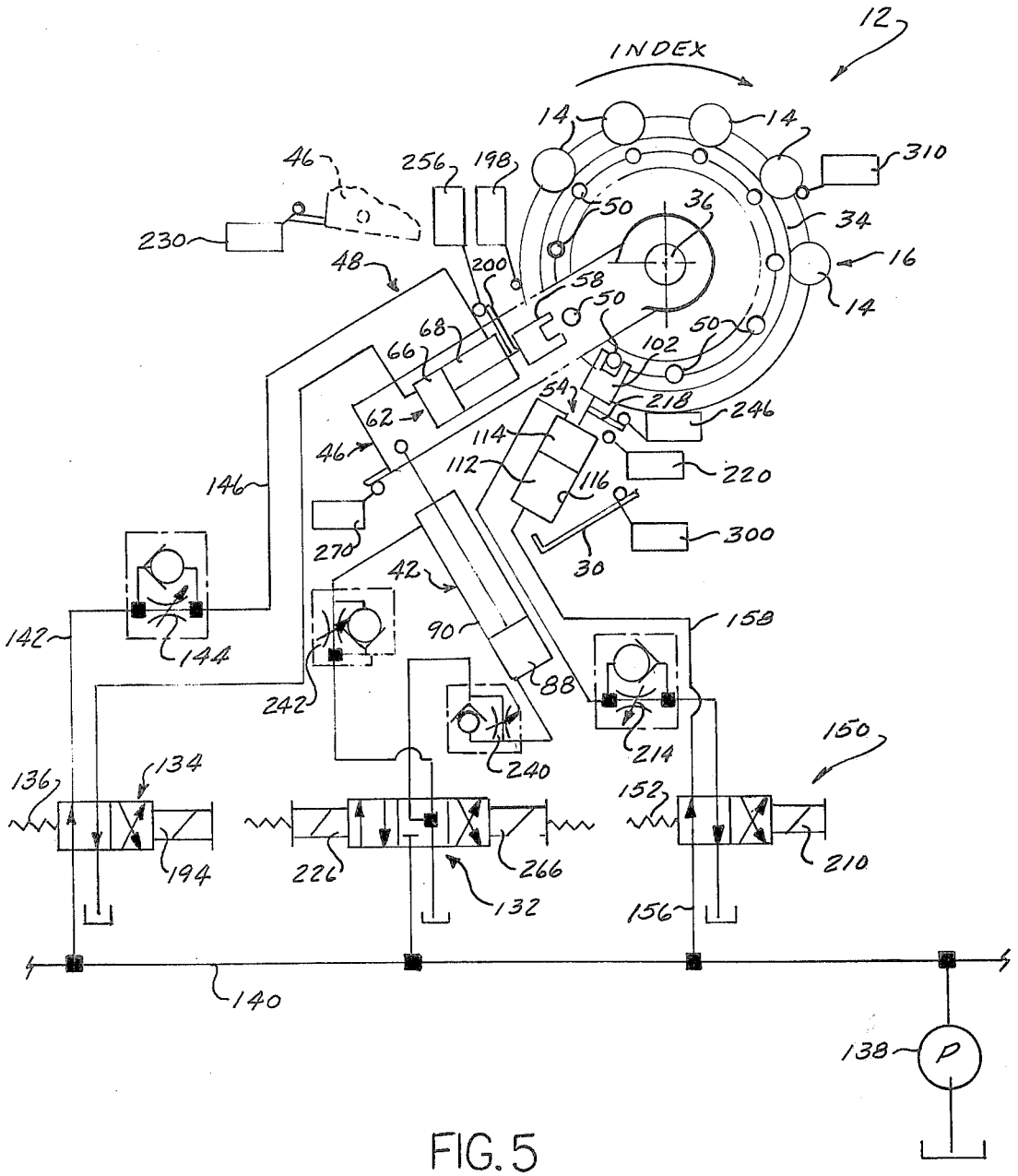
FIG. 5 is a schematic illustration of hydraulic controls utilized in the loading apparatus.

Prior to initiation of a loading cycle, hydraulic controls for the loading apparatus 12 are in the condition illustrated in FIG. 5. At this time the index motor 42 is retracted so that the index arm 46 is in the initial position illustrated in solid lines in FIG. 3. An index motor control valve 132 (FIG. 5) is in an initial position connecting opposite end portions of the index motor cylinder 90 with drain. Therefore, the weight of the index arm 46 and the latch assembly 48 are effective to hold a piston 88 of the index motor 42 in the retracted position.

Prior to initiation of a loading cycle, a latch motor control valve 134 is ured to an unactuated position (shown in FIG. 5) under the influence of a biasing spring 136. When the latch motor control valve 134 is in the unactuated position, the rod end of the latch cylinder 68 is connected with a pump 138 through a conduit 140, valve 134, conduit 142, variable orifice 144 which is utilized to control the rate of operation of the latch motor 62, and a conduit 146. The relatively high fluid pressure in the rod end of the cylinder 68 urges the latch motor piston 66 to the retracted position shown in FIG. 5 so that the latch member 58 is disengaged from the associated index pin 50.

Prior to initiation of a loading cycle, the locking assembly 54 is in the engaged condition holding the wheel 34 against rotation. Thus, a locking motor control valve 150 (FIG. 5) is urged to initial or neutral condition under the influence of a biasing spring 152. The locking motor control valve 150 then ports high pressure fluid to the head end of the locking motor cylinder 116 through conduits 156 and 158.

Figure 6:
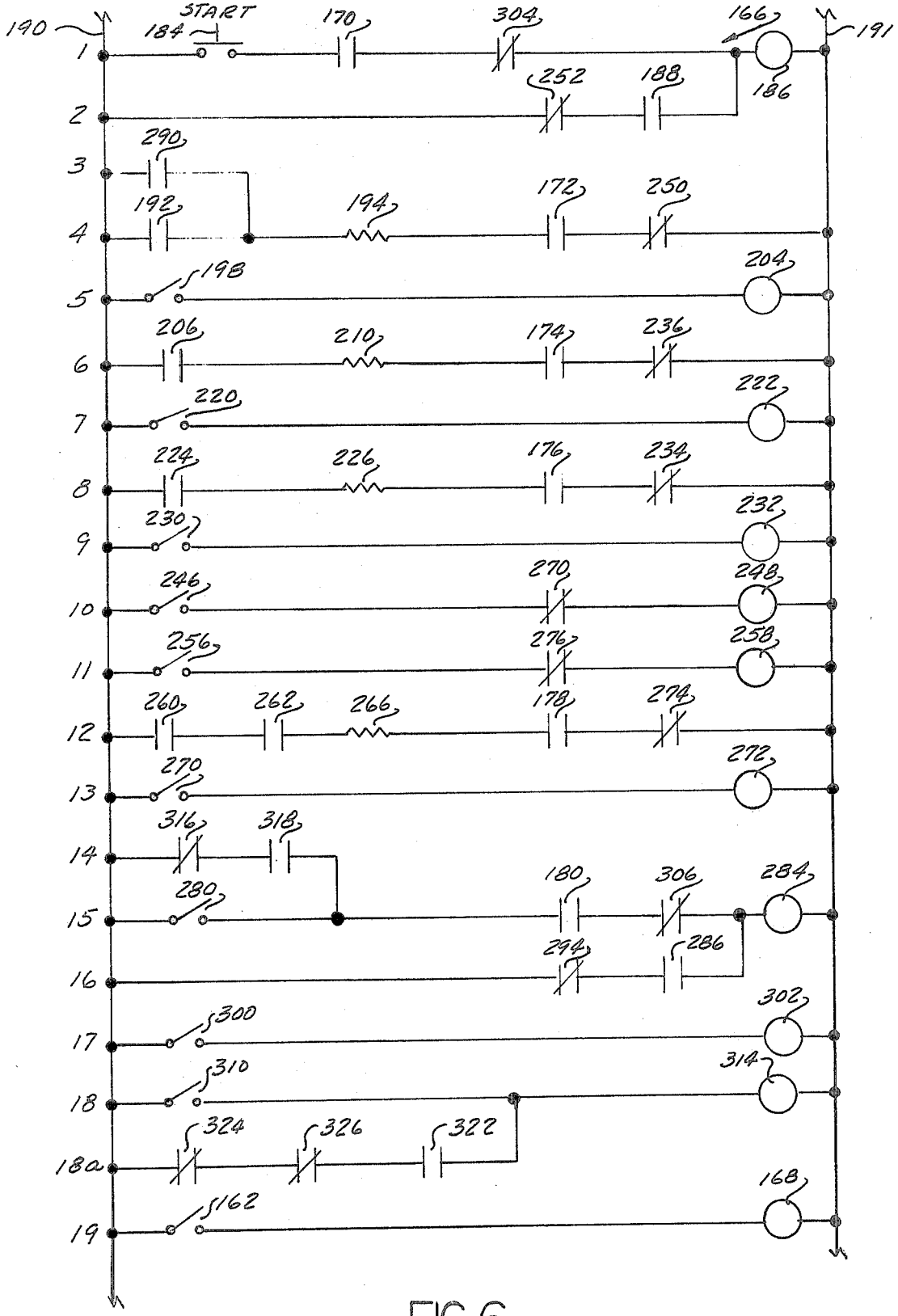
FIG. 6 is a schematic illustration of electrical controls utilized in association with the hydraulic controls of FIG. 5.

Upon initiation of a loading cycle, the frame 106 is in the raised position shown in solid lines in FIG. 3 with the loading wheel 34 extending into th7 work area 16. When the frame 106 is in the raised position, a limit switch 162 (see FIG. 3) is actuated. The limit switch 162 is normally open in the manner illustrated schematically at line 19 of the control circuitry 166 of FIG. 6. Closing of the limit swtich 162 energizes a relay 168 to close its normally open contacts 170, 172, 174, 176, 178 and 180 (see lines 1, 4, 6, 8, 12 and 15 of FIG. 6). To initiate a loading cycle, a start button 184 (line 1 of FIG. 6) is depressed to energize a start relay 186. The start relay 186 is then held in the actuated condition by its normally open contacts 188 (line 2). It should be noted that main lines 190 and 191 (FIG. 6) are connected with a suitable source of power.

Energization of the start relay 188 causes its normally open contacts 192 (line 4) to close to effect energization of a solenoid 194 (line 4 of FIG. 6) to actuate the latch motor control valve 134 (FIG. 5). Actuation of the latch motor control valve 134 ports high pressure fluid from the line 140 to the head end of the latch motor cylinder 68. This high pressure fluid moves the piston 66 outwardly to thereby move the latch member 58 into engagement with the index pin 50. Upon engagement of the latch member 58 with an index pin 50, a normally open limit switch 198 is closed by a member 200 connected with the piston rod of the latch motor 62.

Upon actuation of the limit switch 198 (line 5 of FIG. 6), the control apparatus 166 detects that the latch assembly has been actuated to engage an index pin 50 on the wheel 34 to hold the wheel against rotation relative to the index arm 46. Therefore, the locking assembly 54 can be operated to the disengaged condition. Accordingly, upon closing of the limit switch 198, a relay 204 (line 5 of FIG. 6) is energized and its normally open contacts 206 (line 6 of FIG. 6) are closed to energize a solenoid 210. Energization of the solenoid 210 actuates the locking motor control valve 150 (see FIG. 5) to port high pressure fluid to a variable size flow rate control orifice 214 and the rod end of the locking member 112. This causes the piston 114 to be retracted axially inwardly and move the locking memb er 102 out of engagement with the index pin 50. Once the locking member 102 has been moved out of engagement with the index pin 50, a member 218 actuates a limit switch 220.

Actuation of the limit switch 220 indicates to the control circuitry that the locking assembly 54 has been disengaged from the wheel 34 so that the wheel is free to be rotated under the influence of the index motor 42. Thus, actuation of the normally open limit switch 220 (see line 7 of FIG. 6) energizes a relay 222 to close its normally open relay contacts 224 (line 8) and effect energization of a solenoid 226. Energization of the solenoid 226 effects rightward movement (as viewed in FIG. 5) of the index motor control valve 132 to thereby port high pressure fluid to the head of the index motor cylinder 90. This fluid pressure causes the index motor 42 to be extended and pivot the index arm 46 in a clockwise direction from the initial position illustrated in solid lines in FIG. 5 to the actuated position illustrated in dashed lines in FIG. 5.

When the index arm 46 reaches the actuated position, a limit switch 230 is actuated to indicate that the index arm 46 and loading wheel 34 have been moved together by the index motor 42 through an arcuate distance sufficient to move the next succeeding workpiece into the work area 16 and to move the previously finished workpiece out of the work area 16. Of course, at this time operation of the index motor 42 should be interrupted. Accordingly, closing of the normally open limit switch 230 energizes a relay 232 (line 9 of FIG. 6) to open its normally closed contacts 234 (line 8) and effect a de-energization of the solenoid 226. The index motor control valve 132 then returns to the neutral position illustrated in FIG. 5 under the influence of its spring bias.

Simultaneously with movement of the valve 132 back to the illustrated neutral position, normally closed contacts 236 (line 6 of FIG. 6) of the relay 232 are opened to effect a de-energization of the solenoid 210. This enables the locking motor control valve 150 to return to its initial position under the influence of the biasing spring 152. When the locking motor control valve 150 is moved to the initial position under the influence of the biasing spring 152, high pressure fluid is ported to the head end of the locking motor cylinder 116 and the locking member 102 is moved into engagement with the index pin 50. It should be noted that the variable orifice 214 (FIG. 5) is set so that the locking motor 112 is quickly actuated at the end of the stroke of the index motor 42. A pair of flow control orifices 240 and 242 associated with the index motor 42 are set to a relatively restricted condition so that even though the index motor control valve 132 is actuated to the neutral position simultaneously with actuation of the locking control valve 150 to interrupt movement of the wheel 34, the locking motor 112 is operated to engage the associated index pin 50 before the index motor 42 can begin to be retracted under the influence of the weight of the index arm 46. Of course, this sequencing could be accomplished with suitable electrical circuitry if desired.

After the locking assembly 54 has engaged the wheel 34 to hold the wheel against rotational movement, the latch assembly 48 can be retracted and the index arm returned to the initial position. Accordingly, upon movement of the lock member 102 into engagement with the associated index pin 50, a normally open limit switch 246 is actuated to indicate to the control circuitry 160 that the locking assembly 54 is in the engaged condition. Closing of the limit switch 246 completes a circuit to energize a relay 248 (line 10 of FIG. 6). Energization of the relay 248 opens its normally closed contacts 250 (line 4 of FIG. 6) to interrupt the energization circuit for the latch motor control valve solenoid 194. The latch motor control valve 134 is then returned to its normal position illustrated in FIG. 5 under the influence of the biasing spring 136 with a resulting retraction of the latch member 58 away from the associated index pin 50. In addition, energization of the relay 248 opens its normally closed contacts 252

(line 2 of FIG. 6) to inerrupt the holding circuit for the start relay 186.

After the latch assembly has been retracted to disengage the latch member 58 from the associated index pin 50, the index motor 42 is operated through a return stroke to move the index arm 46 from the raised position illustrated in dashed lines in FIG. 5 to the initial position illustrated in solid lines in FIG. 5. When the latch member 58 is moved to the retracted position shown in FIG. 5, a limit switch 256 is actuated to indicate to the control circuitry 166 that the latch member 58 has been fully withdrawn. Actuation of the normally open limit switch 256 to the closed condition energizes a relay 258 (line 11 of FIG. 6) having normally open contacts 260 (line 12 of FIG. 6) which are closed. It should be noted that at this time the normally open contacts 262 of the relay 248 (line 10) are closed since the latch member 58 is retracted and the limit switch contacts 246 are closed. Of course, the normally open contacts 178 (line 12) of the relay 168 (line 19) are closed since the frame 106 is in the raised position shown in solid lines in FIG. 3 closing the limit switch 162 to effect energization of the relay 168 in the manner previously explained.

Closing of the normally open contacts 260 of the relay 258 effects energization of a solenoid 266 to shift the actuator control valve 132 towards the left (as viewed in FIG. 5). This actuation of the valve 132 ports high pressure fluid to the rod end of the index motor cylinder 90 to move the piston 88 inwardly or downwardly as viewed in FIG. 5. Resulting operation of the index motor 42 pivots the index arm 46 in a counterclockwise direction about the axle 36 to move the index arm from the raised position shown in dashed lines in FIG. 5 to the initial position shown in solid lines in FIG. 5.

When the index arm 46 reaches the initial position, the operation of the index motor 42 is stopped with the latch member 58 in alignment with but spaced apart from a next succeeding index pin 50 in the manner illustrated schematically in FIG. 5. When the index arm 46 reaches the initial position, a limit switch 270 is actuated from its normally open position to effect energization of a relay 272 (line 13 of FIG. 6). Energization of the relay 272 opens its normally closed contacts 274 (line 12) to interrupt the energization circuit for the solenoid 266. The index motor control valve 132 then returns to its initial or neutral position under the influence of biasing springs. In addition, energizing the relay 272 opens its normally closed contacts 276 (line 11 of FIG. 6) to effect de-energization of the relay 258, energizing the relay 272 also opens its normally closed contacts 270 (line 10) to effect a de-energization of the relay 248.

The loading apparatus will remain in the initial condition illustrated schematically in FIG. 5 with the index motor 42 retracted and a normally open limit switch 256 closed, and the lock assembly 54 engaged and the normally open limit switch 246 closed until the next succeeding loading cycle is initiated. Although it could be done manually, it is contemplated that the next succeeding loading cycle will be initiated automatically upon completion of a grinding operation.

During a grinding operation a workpiece which is to be finished is moved axially from a loaded position shown in dashed lines of FIG. 2 on a workpiece support 38 into engagement with the spindle chuck by movement of the footstock 24 toward the spindle chuck 20. The grinding wheel 28 is then moved into engagement with the workpiece 14 and the workpiece is rotated by the spindle chuck 20 and the grinding wheel 28 is rotated by a suitable motor (not shown) to finish the workpiece in a well known manner. When the grinding operation is completed, the grinding wheel 28 is retracted and the headstock 22 is actuated to release the finished workpiece 14 and move it back to the loading position illustrated in dashed lines in FIG. 2.

As the workpiece 14 is moved back to the loading position illustrated in dashed lines in FIG. 2, a limit switch 280 (line 15 of FIG. 6), associated with the headstock 22, is closed. Closing of the normally open limit switch 280 completes a circuit for energizing a relay 284. It should be noted that the normally open contacts 180 (line 15) of the relay 168 (line 14) are closed at this time since the frame 106 is in position to actuate the limit switch 162.

Energization of the relay 284 closes its normally open holding contacts 286 (line 15 of FIG. 6) to complete a holding circuit. In addition, energization of the relay 284 closes its normally open contacts 290 (line 3) to effect energization of the solenoid 194 (line 4) and actuation of the latch motor control valve 134 (FIG. 5). Upon actuation of the latch motor control valve 134, the loading cycle proceeds in the same manner as previously explained. It should be noted that the relay 284 (line 15) is de-energized upon movement of the lock member 102 to the engaged condition by opening of normally closed relay contacts 294 (line 15) of the relay 248 in much the same manner as in which the normally closed contacts 252 (line 2) open the holding circuit for the start relay 186. Thus, a loading cycle is automatically initiated each time a workpiece is moved into the work area 16 by the loading apparatus.

It is contemplated that during continued operation of the loading apparatus 12, there may be an inadvertent failure to empty the chute 30 (FIG. 4) and it will become filled with finished workpieces. Of course, if operation of the loading apparatus was automatically initiated with the chute 30 completely filled a jam up of workpieces would occur with the resulting possibility of damaging the loading apparatus 12. Accordingly, a limit switch 300 (FIG. 5) is provided to detect when the chute 30 has become almost filled with workpieces. When the chute 30 is almost filled with workpieces, the normally open limit switch 300 (line 17 of FIG. 6) is closed and effects energization of a relay 302 which is of the slow actuating type so that its contacts are actuated at a predetermined time period after the closing of the limit switch 300. This time delay is of sufficient duration to enable a loading cycle which has been initiated to be completed.

After the chute 30 has been filled and the limit switch 300 closed for a predetermined time period, normally closed contacts 304 (line 1 of FIG. 6) of the relay 302 are opened to open the circuit from the start button 184 to the relay 186 to prevent initiation of a loading cycle by depressing of the start button 184. In addition, normally closed contacts 306 (line 15) of the relay 302 are opened to prevent completion of a circuit to effect energization of the relay 284 and automatic initiation of a loading cycle upon completion of a grinding operation and closing of the limit switch 280 in the manner previously explained. Therefore, whenever the chute 30 becomes substantially filled with the finished workpieces, the limit switch 300 is actuated to prevent the loading of additional workpieces until after the chute has been emptied.

It is contemplated that during operation of the loading apparatus 12, a loading cycle may be undertaken without a workpiece 14 on one of the workpiece supports 38. When a loading cycle is completed and an empty workpiece support 38 has been moved into the work area 16, a second loading cycle is automatically undertaken. The absence of a workpiece on one of the workpiece supports 38 is detected by a limit switch 310. In the absence of a workpiece on the support 38, the limit switch 310 (line 18 of FIG. 6) is not actuated as the empty workpiece support is moved into the work area 16 from a position adjacent to the work area.

To effect initiation of another loading cycle immediately after the completion of one loading cycle in the absence of the workpiece, a relay 314 (line 18 of FIG. 6) has normally closed contacts 316 (line 14) which complete a circuit when the limit switch 310 is not actuated by engagement with a workpiece on a workpiece support 38 as the support is moved into the work area 16. The contacts 316 of the relay 314 are connected in series with normally open contacts 318 (line 14) of the relay 272 (line 13). Upon completion of a loading cycle and closing of the limit switch 270, the index arm 46 is moved back to the initial position of FIG. 5. The limit switch 270 (line 13) is closed and the relay 272 is energized closing its normally open contacts 318. In the event that an empty workpiece support 38 is moved into the work area, the relay 314 is not energized and its contacts 316 are in the normally closed condition. A circuit is then completed around the repeat switch 280 (line 15 of FIG. 6) to effect energization of the relay 284 and initiation of another loading cycle in the manner previously explained.

On this next succeeding cycle, the wheel 34 is indexed and the next succeeding workpiece 38 is moved into the work area 16. Assuming that there is workpiece on the next succeeding workpiece support, the limit switch 310 (line 18 of FIG. 6) is closed and effects energization of the relay 314. Energization of relay 314 causes its own normally open contacts 322 (line 18a of FIG. 6) to close completing a holding circuit through the normally closed contacts 324 of the relay 186 (line 1 of FIG. 6) and the normally closed contacts 326 of the relay 284 (line 15 of FIG. 6). Upon actuation of the limit switch 310 and energization of the relay 314 (line 18 of FIG. 6) the normally closed contacts 316 (line 14) of the relay 314 are opened to thereby open the circuit around the repeat switch 280 so that a repeat loading cycle is not automatically initiated upon energization of the relay 272 and closing of its contacts 318 as the index arm 46 returns to the initial position of FIG. 5.

It should be noted that the electrical circuitry 166 has been simplified by the elimination of various interlock contacts and circuitry associated with various control functions of the grinding machine 10. Although the control circuitry 166 has been shown in FIG. 6 as utilizing relays, it is contemplated that various solid state devices could be interconnected to perform the functions of the circuitry 166. In addition, it is contemplated that the hydraulic circuitry illustrated schematically in FIG. 5 could be of a construction other than the specific construction illustrated therein.

Although the limit switches 230 and 270 have been illustrated in FIG. 5 as being actuated by a projection from the end of the index arm 26, in the actual embodiment of the invention illustrated in FIG. 3, the limit switches 230 and 270 are actuated by projections 340 and 342 which are connected by an arm 344 and are fixedly connected to the index arm 46.

It is contemplated that during the grinding of certain workpieces the automatic loading assembly 12 will not be utilized. When the loading assembly 12 is not to be utilized, it is advantageously pivoted about connections 346 and 348 between the frame 106 and the base 108 to retracted position illustrated in dashed lines in FIG. 3. When the loading assembly 12 is in the retracted position, the loading wheel 34 is disposed to one side of and below the work station 16 and is entirely out of the way of work operations being performed at the work station. It should be noted that when the frame 106 is in the retracted position illustrated in dashed lines in FIG. 3, the limit switch 162 is in an unactuated condition so that relay 168 (line 19 of FIG. 6) is unactuated. The unactuated relay 168 opens the various circuits to effect de-energization of the motor control solenoids so that the loading apparatus can not be inadvertently actuated while in a retracted condition. Thus, de-energization of the relay 168 results in the opening of its contacts 170 (line 1 of FIG. 6) to prevent initiation of a loading cycle by the inadvertent pressing of the start button 184. In addition, the contacts 172, 174, 176 and 178 open to prevent operation of the index, latch and locking motors. Finally, the contacts 180 (line 15 of FIG. 6) of the relay 168 open to prevent the initiation of a loading cycle in the event that the switch 280 in the grinding machine is actuated during the machining of a workpiece with the loading apparatus in the retracted position shown in dashed lines in FIG. 3.

In view of the foregoing description it is apparent that the grinding machine 10 has an improved workpiece loader assembly 12 which sequentially transports a plurality of workpieces 14 to a work area 16. The loader assembly 12 includes an index motor 42 which is operated through a loading stroke to effect pivotal movement of an index arm 46 and rotation of a loading wheel to move an unfinished workpiece 14 to the work area 16 and to remove a finished workpiece from the work area. During the loading stroke, a latch assembly 48 on the index arm 46 engages the wheel 34. The latch assembly 48 is moved with the wheel 34 by the index motor 42 to effect movement of the loading wheel. During a return stroke of the index motor 42, the wheel 34 is held stationary by a lock assembly 54.

It is contemplated that during operation of the loading apparatus 12, the loading wheel 34 may be rotated to move an empty workpiece support 38 into the work area 16. When this occurs, the loading cycle is automatically repeated to move the next succeeding workpiece support 38 into the work area. It is also contemplated that during operation of the machine a finished workpiece discharge chute 30 may become filled. A suitable detector 300 is provided to prevent the initiation of a loading cycle when the discharge chute is filled. In addition, it is contemplated that the grinding machine 10 will be utilized to perform work operations in which the loading apparatus 12 will not be utilized. During the performance of these work operations, the loading apparatus 12 is moved to an inactive position (shown in dashed lines in FIG. 3) in which the wheel is spaced apart from the work area.

Having described one specific preferred embodiment of the invention, the following is claimed:

1. An apparatus for use in sequentially grinding a plurality of workpieces in a work area, said apparatus comprising a base, chuck means connected with said base for holding each workpiece in turn in the work area, grinding means for grinding each workpiece in turn while the workpiece is being held by said chuck means, and workpiece transport means for sequentially transporting workpieces to the work area, said workpiece transport means including a wheel which is rotatable relative to said base, a plurality of workpiece support means disposed on said wheel at equally spaced locations for supporting a plurality of workpieces, index motor means operable through loading and return strokes, latch means movable by said index motor means relative to said base through loading and return strokes, said latch means being operable between a first condition engaging said wheel to rotate said wheel relative to said base upon operation of said index motor means to move said latch means through a loading stroke and a second condition in which said latch means is ineffective to rotate said wheel upon operation of said index motor means to move said latch means through a return stroke, latch motor means for effecting operation of said latch means between the first and second conditions, locking means operable between an engaged condition holding said wheel against rotation relative to said base and a disengaged condition in which said locking means is ineffective to hold said wheel against rotation relative to said base, locking motor means for effecting operation of said locking means between the engaged and disengaged conditions, and control means for effecting operation of said latch motor means to operate said latch means to the first condition, for effecting operation of locking motor means to operate said locking means from the engaged condition to the disengaged condition upon operation of said latch means to the first condition, for effecting operation of said index motor means to move said latch means through a loading stroke with said latch means in the first condition upon operation of said locking means to the disengaged condition to move said latch means and said wheel relative to said base through a distance sufficient to move a workpiece supported on said wheel into the work area, for effecting operation of said locking motor means to operate said locking means to the engaged condition upon operation of said index motor means through a loading stroke, for effecting operation of said latch motor means to operate said latch means to the second condition upon operation of said locking means to the engaged condition, and for effecting operation of said index motor means to move said latch means relative to said base through a return stroke with said latch means in the second condition and said locking means in the engaged condition.

2. An apparatus as set forth in claim 1 wherein said workpiece transport means includes means for supporting said wheel for movement between an operating position in which said wheel extends into the work area and a nonoperating position in which said wheel is spaced apart from the work area.

3. An apparatus as set forth in claim 1 further including means for defining a plurality of spaced indexing locations on said wheel, each of said indexing locations being engaged in turn by said latch means during movement of said latch means through loading strokes, each of said indexing locations being engaged in turn by said locking means during movement of said latch means through return strokes.

4. An apparatus as set forth in claim 1 wherein said control means includes sensor means for detecting the absence of a workpiece on the support means which will move into the work area on the next loading stroke of said index motor means, and means for effecting operation of said index motor means through another loading stroke in response to the detection of the absence of a workpiece by said sensor means.

5. An apparatus as set forth in claim 1 wherein said index motor means includes a first piston and cylinder assembly which is axially extendable along a first axis to effect operation of said index motor means through a loading stroke, said latch motor means including a second piston and cylinder assembly which is axially extendable along a second axis extending transverse to said first axis to effect operation of said latch means from the second condition to the first condition.

6. An apparatus as set forth in claim 1 further including a support member, means connected with one end portion of said support member for supporting said support member for pivotal movement relative to said base about an axis which is coincident with the axis of rotation of said wheel, means for connecting said index motor means with a second end portion of said support member to enable said index motor means to pivot said support member about the axis of rotation of said wheel upon operation of said index motor means through loading and return strokes, said latch means and said latch motor means being disposed on said support member for movement therewith relative to said base upon operation of said index motor means through loading and return strokes.

7. An apparatus as set forth in claim 1 further including positioning means for sequentially engaging one end portion of each of the workpieces in turn as the workpiece is being moved by said wheel to position the workpiece relative to said workpiece support means.

8. An apparatus as set forth in claim 1 further including chute means for receiving workpieces which have been ground by said grinding means, detector means for detecting when said chute means is filled with workpieces, and means for preventing operation of said index motor means to move said wheel when said detector means detects that said chute is filled with workpieces.

9. An apparatus as set forth in claim 1 wherein said control means includes first detector means for detecting when said latch means has been operated to the first condition, citcuit means for effecting operation of said locking motor means to operate said locking means from the engaged condition to the disengaged condition in response to detection by said first detector means of operation of said latch means to the first condition, second detector means for detecting when said locking means has been operated to the disengaged condition, circuit means for effecting operation of said index motor means to move through a loading stroke with said latch means in the first condition in response to detection by said second detector means of operation of said locking means to the disengaged condition, third detector means for detecting when said index motor means has been operated through a loading stroke, circuit means for effecting operation of said locking motor means to operate said locking means to the engaged condition in response to detection by said third detector means of operation of said index motor means through a loading stroke, fourth detector means for detecting when said locking means has been operated to the engaged condition, circuit means for effecting operation of said latch motor means to operate said latch means from the first condition to the second condition in response to detection by said fourth detector means of operation of said locking means to the engaged condition, fifth detector means for detecting when said latch means has been operated to the second condition, and circuit means for effecting operation of said index motor means through a return stroke in response to detection by said fifth detector means of operation of said latch means to the second condition.

10. An apparatus for use in sequentially grinding a plurality of workpieces in a work area, said apparatus comprising a base, chuck means connected with said base for holding each workpiece in turn in the work area, grinding means for grinding each workpiece in turn while the workpiece is being held by said chuck means, and workpiece transport means for sequentially transporting workpieces to the work area, said workpiece transport means including a wheel which is rotatable relative to said base, a plurality of workpiece support means disposed on said wheel for supporting a plurality of workpieces, said plurality of workpiece support means being disposed in a circular array about the circumference of said wheel and having central axes which are spaced apart by equal arcuate distances, a plurality of index locations disposed in a circular array on said wheel and having central axes which are spaced apart by an arcuate distance equal to the arcuate distance between central axes of adjacent workpiece support means, a support member having first and second spaced apart end portions, means for supporting said first end portion of said support member for pivotal movement about an axis which is coincident with the axis of rotation of said wheel, index motor means connected with said second end portion of said support member for effecting pivotal movement of said support member about the axis of rotation of said wheel, said index motor means being operable through a loading stroke to effect rotation of said support member in a first direction about the axis of rotation of said wheel through an arcuate distance equal to the arcuate distance between central axes of adjacent workpiece support means and through a return stroke to effect rotation of said support member in a second direction about the axis of rotation of said wheel, and latch means disposed on said support member for engaging at least one of said index locations during operation of said index motor means through a loading stroke and rotational movement of said support member in said first direction to effect rotation of said wheel in said first direction through an arcuate distance equal to the arcuate distance between central axes of adjacent workpiece support means, said latch means including means for rendering said latch means ineffective to effect rotation of said wheel during operation of said index motor means through a return stroke.

11. An apparatus as set forth in claim 10 wherein said latch means includes a latch member disposed on said support member and movable between a first position engaging at least one of said index locations on said wheel and a second position in which said latch member is ineffective to engage said index locations, said means for rendering said latch means ineffective including latch motor means disposed on said support member for effecting movement of said latch member between said first and second positions.

12. An apparatus as set forth in claim 11 further including first detector means disposed on said support member for detecting when said latch member is in said first position, second detector means disposed on said support member for detecting when said latch member is in said second position, and control means for effecting operation of said index motor means through a loading stroke only when said first detector means detects that said latch member is in said first position and for effecting operation of said index motor means through a return stroke only when said second detector means detects that said latch member is in said second position.

13. An apparatus as set forth in claim 11 wherein said latch motor means includes a piston and cylinder assembly which is connected to said latch member, said piston and cylinder assembly being operable from a retracted condition to an extended condition to move said latch member relative to said support member from said second position to said first position, said piston and cylinder assembly being operable from the extended condition to the retracted condition to move said latch member relative to said support member from said first position to said second position.

14. An apparatus as set forth in claim 10 further including means for supporting said wheel, support member, index motor means and latch means for movement together relative to said base between an operating condition in which said wheel extends into the work area and an inactive condition in which said wheel is spaced apart from the work area.

15. An apparatus for use in sequentially grinding a plurality of workpieces in a work area, said apparatus comprising a base, chuck means connected with said base for holding each workpiece in turn in the work area, grinding means for grinding each workpiece in turn while the workpiece is being held by said chuck means, and workpiece transport means for sequentially transporting workpieces to the work area, said workpiece transport means including a wheel which is rotatable relative to said base, a plurality of workpiece support means disposed on said wheel at equally spaced locations for supporting a plurality of workpieces, index motor means for effecting rotational movement of said wheel to sequentially move workpieces into the work area, and wheel support means for supporting said wheel and index motor means for movement relative to said base between an operating position in which said wheel extends into the work area and an inactive position in which said wheel is spaced apart from said work area.

16. An apparatus as set forth in claim 15 further including an axle about which said wheel is rotated upon operation of said index motor means, said wheel support means including frame means connected with said axle on opposite sides of said wheel for supporting said axle, and means for supporting said frame means for movement relative to said base.

17. An apparatus as set forth in claim 16 wherein said means for supporting said frame means for movement relative to said base includes mounting means for pivotally connecting said frame means to said base and for enabling said frame means to be pivoted away from said base to effect movement of said wheel from said operating position to said inactive position.

18. An apparatus as set forth in claim 15 further including control means for preventing operation of said index motor means when said wheel is in said inactive position.

19. An apparatus for use in sequentially grinding a plurality of workpieces in a work area, said apparatus comprising a base, chuck means connected with said base for rotating each workpiece in turn about an axis of rotation disposed in a predetermined position in the work area, grinding means for grinding each workpiece in turn while the workpiece is being rotated in the work area by said chuck means, and workpiece transport means for sequentially transporting workpieces to the work area, said workpiece transport means including a wheel support frame which is movable relative to said base, a wheel which is rotatably mounted on said support frame for rotation relative to said base, a plurality of workpiece support means disposed on said wheel for supporting a plurality of workpieces, means for rotating said wheel relative to said support frame about an axis which extends parallel to the axis about which each workpiece is rotated in the work area by said chuck means to sequentially move workpieces to the work area, said wheel support frame being movable relative to said base to move said wheel between an operating position in which the axis of rotation of said wheel is spaced a first distance from the axis about which each workpiece is rotated in the work area by said chuck means and an inactive position in which the axis of rotation of said wheel is spaced a second distance from the axis about which each workpiece is rotated in the work area by said chuck means, said second distance being greater than said first distance so that said wheel is spaced apart from the work area when said wheel is in said inactive position.

20. An apparatus as set forth in claim 19 wherein said means for rotating said wheel is connected with said wheel support frame for movement therewith and includes an index arm pivotal about an axis which is coincident with the axis of rotation of said wheel, index motor means connected with said index arm for effecting pivotal movement of said index arm about the axis of rotation of said wheel, said index motor means being operable through a loading stroke to effect rotation of said index arm in a first direction about the axis of rotation of said wheel and through a return stroke to effect rotation of said index arm in a second direction about the axis of rotation of said wheel, and latch means disposed on said index arm for connecting said wheel with said index arm during operation of said index motor means through a loading stroke and rotational movement of said index arm in said first direction to effect rotation of said wheel in said first direction, said latch means including means for rendering said latch means ineffective to connect said wheel with said index arm during operation of said index motor means through a return stroke.

21. An apparatus as set forth in claim 20 wherein said latch means includes a latch member disposed on said index arm and movable between a first position operatively engaging said wheel and a second position in which said latch member is ineffective to operatively engage said wheel, said means for rendering said latch means ineffective including latch motor means disposed on said index arm for effecting movement of said latch member between said first and second positions.

22. An apparatus as set forth in claim 20 wherein said index motor means includes a piston and cylinder assembly having a first end portion connected with said wheel support frame and a second end portion connected with said index arm, said piston and cylinder assembly being axially extendable and retractable to effect rotation of said index arm.

23. An apparatus as set forth in claim 19 further including control means for preventing operation of said means for rotating said wheel when said wheel is in said inactive position.

* * * * *